United States Patent [19]

Miller, Sr.

[11] 4,210,001

[45] Jul. 1, 1980

[54] REFRIGERATION SYSTEM HAVING IMPROVED HEAT TRANSFER AND REDUCE POWER REQUIREMENT FOR VARIOUS EVAPORATIVE REFRIGERANTS

[76] Inventor: Bruce D. Miller, Sr., 3303 Chickadee Rd., Louisville, Ky. 40213

[21] Appl. No.: 929,852

[22] Filed: Jul. 31, 1978

[51] Int. Cl.[2] ..... F25B 43/02

[52] U.S. Cl. ..... 62/468; 62/470; 62/473

[58] Field of Search ..... 62/470, 473, 468, 84, 62/192

[56] References Cited

U.S. PATENT DOCUMENTS

| | | | |
|---|---|---|---|
| 3,534,564 | 10/1970 | Miller | 62/470 |
| 3,837,175 | 9/1974 | Miller | 62/470 |

*Primary Examiner*—Ronald C. Capossela
*Attorney, Agent, or Firm*—Maurice L. Miller, Jr.

[57] ABSTRACT

A refrigeration system employing oil lubricated compressors has an improved arrangement for removing oil contaminations from the hot gas contaminated with oil from the compressor. This is done by desuperheating the hot refrigerant gas with indirect contact cooling by flashing liquid at the condenser pressure, heating or evaporating water and heating air, and is applicable to all evaporative refrigerants: miscible and immiscible with lubricating oil.

In addition, improved features for better contact of liquid and hot gas in present equipment by reducing density, improved inlet connection for receivers now in operation to minimize agitation, improved rapid defrosting by condensing clean gas with clean condensate remaining in the evaporator for chilling as the pressure is reduced, new non-entrainment trap for collecting non-condensible gases, and new application with siphonic tee utilizing high velocity gas from the compressor for drawing in gas at equalized pressure to be returned to the condenser.

21 Claims, 14 Drawing Figures

REFRIGERATION SYSTEM HAVING IMPROVED HEAT TRANSFER AND REDUCE POWER REQUIREMENT FOR VARIOUS EVAPORATIVE REFRIGERANTS

BACKGROUND OF THE INVENTION

The necessity for removing oil and non-condensible gases for maximum efficiency of refrigeration systems has long been recognized, and many proposals, including my U.S. Pat. Nos. 2,149,358, 3,534,564, and 3,837,175, have been advanced. Oil lubricated compressors are a conventional part of commercial refrigeration systems and are the source of the oil that reduces the heat transfer coefficient. Conventional traps collect the oil droplets in the hot gas and return the oil to the compressor. Our method of desuperheating the gas before passing through slanted apertured baffles with zig-zag flow pattern causes the cooled oil mist to coalesce and collect on surfaces, and the foam bubbles are ruptured by the sharp edges of the baffles; the oil droplets gravitate down the stationary baffle structure into the oil trap to be continuously returned to the compressor at reduced pressure, after heating to remove the saturated gas and vaporize any liquid present before the oil enters the compressor crankcase, to minimize foaming.

Our Desuperheater & Separator units with direct contact cooling now operating in a number of ammonia refrigeration plants are collecting substantial amounts of oil from the hot gas that passes through the conventional type traps as mist and foam with the hot gas. The indirect contact cooling by flashing liquid refrigeratant at condenser pressure is applicable for desuperheating the various evaporative refrigerant gases, miscible or immiscible with oil, as the liquid does not contact the oil when a conventional type heat exchanger is used with the hot gas contaminated with oil flowing through the tubes of the heat exchanger. The tubes are surrounded with liquid refrigerant at the condenser pressure causing the liquid to flash to gas (vaporize) as the hot contaminated gas is cooled.

The cooled mixture of gas and oil is forced from the heat exchanger into our Oil Mist Separator-Collector (OMSC Unit) constructed very much like our Desuperheater & Separator unit with stationary slanted baffles where the bubbles are ruptured and the cooled oil mist coalesces and collects on the surfaces and flows into the oil trap to be returned to the compressor. The clean cooled gas is forced into the condenser; the heat transfer coefficient is improved by removing the oil before the gas enters the condenser. Also the coefficient is much higher when condensing gas than it is when cooling gas, which reduces the head pressure required to condense the gas and saves power to operate the compressor. The clean liquid gravitates from the condenser with non-entrainment trap, for collecting the non-condensible gases, into a standard receiver with our non-agitating inlet connection to minimize agitation of any oil in the receiver. This permits draining oil from the receiver during operation when ammonia is the refrigerant; the oil settles to the bottom of the vessel.

SUMMARY

The refrigeration system of the invention includes the usual compressor, condenser, receiver and evaporator, together with additional features for improving the chilling efficiency and saving power. These features are: heat exchanger for desuperheating the hot gas by indirect contact cooling; the OMSC unit with alanted apertured baffles for rupturing the foam bubbles, causing the cooled oil mist to coalesce and collect on the surfaces, with the oil droplets gravitating into the oil trap to be returned continuously to the compressor; the siphonic tee located in the high velocity gas line to draw gas from the heat exchanger at equalized pressure to be returned to the condenser permitting location of the condenser on the same elevation as the heat exchanger; the non-entrainment trap for collecting the non-condensible gases and reducing the head pressure; the low temperature high pressure condenser cools the mixture of refrigerant gas and non-condensible gases to low temperatures at high pressure causing most of the refrigerant gas to condense due to the partial pressure of mixed gases. The cold liquid created as the refrigerant gas is condensed overflows into the fluid flowing down to the heat exchanger for use in desuperheating the hot gas. The wet gas created as liquid flashes and flows from the top of the heat exchanger shell into the wet gas separator, with the wet gas returning to the condenser. The static head of liquid from the elevated condenser forces the saturated gas back to the condenser, the siphonic tee is used for drawing the saturated gas from the heat exchanger and wet gas separator when the condenser is not elevated sufficiently to force the gas back to the condenser. The liquid from the bottom of the wet gas separator flows into the shell of the heat exchanger or receiver. The liquid from the condenser and cold liquid from the low temperature condenser flows into the heat exchanger with surplus liquid overflowing into a standard receiver without a control valve. The receiver is modified by inserting flexible hose in the inlet connection with wire to position outlet end of hose above the oil level in bottom of the ammonia receiver, to minimize agitation of the oil caused by falling and rapidly moving liquid. This feature permits modification of existing equipment to perform this function as covered in my earlier patent. The liquid refrigerant flows through the receiver with any oil pickup from low points in an existing contaminated system and the liquid refrigerant is forced from the receiver by gas pressure through the outlet line to the expansion valves. This line in a standard receiver is welded to the top of the vessel with bottom end slightly above the bottom of the receiver allowing space for the heavy oil to accumulate and be drained if not agitated by falling liquid ammonia from the top inlet connection of a standard receiver. This feature eliminates this problem.

The liquid refrigerant from the receiver flows through the sub-cooling coils in the slop tank for evaporating any liquid in the oil before passing through the thermostatic control valve in the line to the oil heater. The sub-cooled liquid passes through the float expansion valve where the pressure is reduced and 15–20% of the liquid flashes to gas to reduce temperature of the remaining liquid and the gas from the receiver temperature to the evaporator temperature, when ammonia is the refrigerant.

The combination float valve tank and knock-out drum protects the compressor from liquid, and improves the chilling efficiency of the evaporator by discharging wet gas instead of superheated gas. The unit is located in elevated relationship to the evaporator to discharge wet gas instead of superheated gas, which increases the chilling efficiency of the evaporator, also this combination tank is arranged with a series of slanted baffles for coalescing the cold liquid mist, and the droplets gravitate down into a stabilized liquid layer maintained by the float valve, with the high velocity gas and liquid entering near the top of the vessel to minimize agitation, and the dry cold gas is returned from the top of the tank to the compressor. Also the float valve is arranged with float switch for closing solenoid valve in the liquid feed line to further protect the compressor from liquid.

This combination float valve tank and knock-out drum is arranged with valves for defrosting the evaporator coils with the usual amount of liquid remaining in this tank.

For rapid defrost, the clean gas is condensed in the evaporator at about 70# pressure and 47° F. ammonia condensing temperature which melts the frost rapidly. The clean condensate remains in the coils to be evaporated as the pressure is reduced and the chilling operation is restored. Also, the same procedure is used defrosting a contaminated system, except when the coils are defrosted; the condensate (liquid and oil) in the coil is dumped into the slop tank where the liquid is evaporated by sub-cooling the high pressure liquid before reaching the expansion valve to salvage the BTU in the cold liquid created as the evaporator is defrosted. Also, the oil collected in the OMSC unit trap is returned to the slop tank, where the oil is heated by sub-cooling the high pressure liquid to evaporate any liquid in the oil and reduce the amount of saturated gas in the oil before the pre-set thermostatic valve opens to permit the oil to flow down through the jacketed line oil heater where the oil is heated by the hot gas from the compressor, and flows into the oil supply tank to maintain the desired oil level in the compressor; and the above features for collecting oil from the various evaporative type refrigerants may all or part be added to existing refrigeration systems in order to improve the efficiency of same and without requiring complete reconstruction of such existing system.

These and other objects and advantages of the invention will become more apparent as the description proceeds and when considered in conjunction with the accompanying drawings in which.

Figure 1:
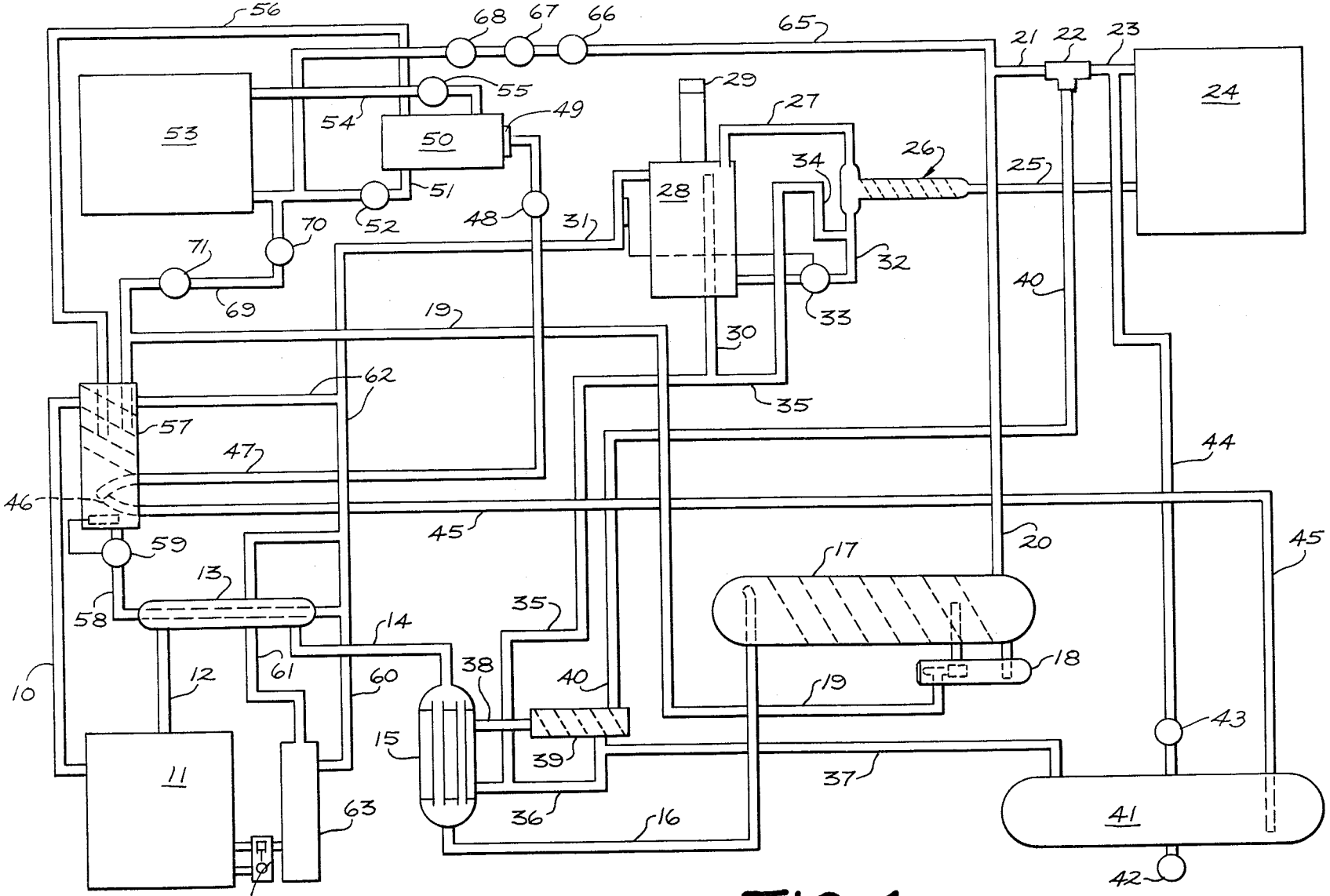
FIG. 1 is a diagrammatic view of standard refrigeration system with improved features.

Referring first to FIG. 1, cold spent gas from the evaporator, ammonia, freon, R-12, R-22, etc., (all temperatures and pressure given are for ammonia refrigerant) is supplied through pipe 10 to an oil lubricated compressor 11 and delivers hot contaminated gas 200° F., or higher through pipe 12 into oil heater 13, where the oil flowing to the oil supply tank 63 is heated above 120° F. to drive off gas and minimize foaming in the compressor. The hot gas with oil from the compressor is thereby cooled before entering the standard shell and tube heat exchanger 15 through pipe 14. There the hot gas is desuperheated by flashing (vaporizing) liquid refrigerant at condenser pressure surrounding the tubes as the hot gas with oil from the compressor is cooled as it passes through the tubes.

The cooled gas with oil, foam and mist enters the Oil Mist Separator-Collector (OMSC unit) 17 through pipe 16 where the foam bubbles are ruptured by sharp edges of the slanted apertured baffles described in my earlier patent. The cooled oil mist in the gas will coalesce and collect on surfaces as it flows concurrent with the gas and oil through the zig-zag flow pattern created by the baffle arrangement. The oil droplets gravitate down the stationary baffle structure into the oil trap 18, with the oil entering the trap near the bottom and gas vent from top of trap extending above the oil level in the OMSC unit 17. Also this oil trap 18 is arranged with a float control valve to continuously dump the oil that accumulates in said trap back to the compressor through line 19 into line 69 connected into the top of slop tank 57 at about 20# suction pressure. There the oil is heated by coil 46 which sub-cools the high pressure refrigerant liquid before it enters expansion valve 49. The heated oil flows from the bottom of slop tank 57 through thermostatic valve 59 set to open at about 30° F. to vaporize any liquid refrigerant in the oil at about 20# pressure flowing from the slop tank and the heated oil flows through pipe 58 into oil heater 13 where the oil is further heated to minimize foaming in the compressor. The hot oil from 13 flows down pipe 60 into the oil supply tank 63 arranged with float valve assembly 64 for maintaining the desired oil level in the compressor 11. Also the gas created as the oil is heated is returned to the slop tank 57 through line 62 with vent line 61 connected into the top of oil supply tank 63.

The clean cooled gas from the OMSC unit 17 flows up line 20 with branch connection 65 for defrosting the evaporator. The high velocity gas at about 110° F. enters the siphonic tee 22 from pipe 21 where the siphonic action draws in gas from line 40 connected to wet gas separator 39 with pipe 38 into the shell of the heat exchanger 15 with equalized gas pressure when the heat exchanger and the condenser are on about the same elevation. The mixture of clean gas from the OMSC unit 17 at about 110° F. and saturated gas from the heat exchanger about 86° F. and at condenser pressure enters the condenser through pipe 23. Also the equalizing line 44 from top of the receiver 41 is connected into pipe 23. This gas along with any non-condensible gases in the system are forced into the top of the condenser 24 at high velocity by the compressor 11. The cooling load has been substantially reduced by desuperheating the hot gas and the condensing load is increased the same amount, the total BTU load on condenser 24 is exactly the same with hot gas or desuperheated gas entering the condenser, but the BTU heat transfer coefficient is much higher when condensing gas that it is when cooling gas, and more surface is available for condensing gas in condenser 24 when the gas is cooled before entering the condenser. Also the amount of scale formation on tubes in condenser 24 is reduced by desuperheating the gas which also saves power by reducing the head pressure required to condense the gas to a liquid in condenser 24 by heating water and air, also evaporating water flowing over outer surface of the condensing coils.

The refrigerant gas is condensed as it flows down through the condenser 24 and the concentration of non-condensible gases increases as the refrigerant gas is condensed to a liquid; also the condensing temperature is lowered as the percent of non-condensible gases is increased due to the partial pressure on mixed gases. The liquid flowing down through the condensing coils entrains the gases which collect in trap 26 after flowing through liquid outlet line 25 partially filled with liquid to minimize agitation and provide space for gas to flow into the trap 26 with slanted baffles to stabilize the liquid and rupture foam bubbles as pure liquid overflows through line 34 to maintain the desired liquid level in the trap 26 and the non-condensible gases at liquid temperature and pressure flows through line 27 to be condensed in low temperature high pressure condenser 28 to salvage refrigerant gas that will condense at suction temperatures and condenser pressure before venting the non-condensible gases to the atmosphere. The low temperature condenser is cooled by expanding high pressure liquid from line 32 about 86° F. and into low pressure jacket at about 20# pressure and 5° F. liquid with control valve 33 and the gas returning to the slop tank 57 through lines 31 and 62.

The liquid created by condensing refrigerant gas in the non-condensibles at low temperature overflows into the high pressure liquid line and the non-condensible gases are automatically vented from the top of gas accumulator in the low temperature high pressure condensing unit 28.

The clean liquid flows down line 35 into line 36 leading to the heat exchanger and wet gas separator 39 with overflow line 37 to maintain the desired liquid level in the heat exchanger without level controller. The remaining liquid overflows through line 37 into standard receiver 41 with oil drain valve 42 and equalizing line 44 with check valve 43 flowing to the condenser, also liquid outlet line 45 from near bottom of the receiver into coil 46 through line 47 with valve 48 through float valve 49 into tank 50, where the pressure is reduced from about 154# to 20# and about 17% of the liquid flashes to cool the remaining liquid and gas from receiver temperature about 86° F. to float valve tank temperature about 5° F.

The cold liquid from tank 50 flows through line 51 and valve 52 into bottom of the evaporator 53 where liquid is evaporated by cooling air, water, brine, etc., the wet gas discharging from top of the evaporator through line 54 with valve 55 returns into top of tank 50 with dry gas outlet 56 from tank 50 into slop tank 57 and line 10 from slop tank to suction of compressor 11 which completes the refrigeration cycle.

THIS INVENTION PROVIDES MEANS:

For rapid defrost of evaporator 53 by condensing clean gas with usual amount of liquid remaining in tank 50.

Procedure: Stop water pump and air blowers to condenser 24 which increases gas pressure, close liquid feed valve 52 in line 51 from tank 50 to evaporator 53 with cold air blower running to evaporate the small amount of liquid in the evaporator and the compressor runs until suction pressure is reduced from 20# to about 5#.

With stopped compressor, stop cold air blower, close gas valve 55 in line 54, open high pressure gas valve 66 in line 65 and adjust pressure reducing valve 67 to maintain about 70# pressure in line 65 leading to line 51 and into bottom of evaporator 53, where the gas is condensed as any liquid present is heated along with the metals of construction. As the gas bubbles up through the liquid in the evaporator coils, it condenses creating uniform temperature through the coilage.

When the coil temperature reaches 32° F., the frost on the outer surface of coil begins to melt and each pound of ammonia gas condensed at 70# and about 47° F. will melt more than 3.5# of ice, and defrosts the evaporator in a short time. When the evaporator 53 is properly defrosted, close high pressure gas valve 66, start cold air blower, open gas valve 55 and liquid valve 52, start compressor, water pump, and blower to condenser 24.

The clean condensate created by condensing clean gas remains in evaporator 53 and tank 50 to be evaporated when the chilling operation is restarted which shortens the total defrost period.

The same procedure is used for defrosting a contaminated system except when the evaporator 53 is defrosted and high pressure gas valve 66 is closed with cold air blower on, then open drain valve 70 in line 69 from bottom of evaporator 53 into slop tank 57 with check valve 71 and the 70# pressure in the evaporator will rapidly force the contaminated liquid from coilage into the slop tank at lower temperature, then close drain valve 70. Open gas valve 55 and liquid valve 52, and start the compressor, water pump, and air blower to condenser 24, to restore the chilling operation.

The refrigeration system described above and outlined in FIG. 1 is applicable to the various evaporative refrigerants. Also, it is understood that additional valves and controls may be added to simplify the operation and control flow rates in this system to improve the desuperheating the collection of oil from the hot gas before the gas enters the condenser 24, which reduces the head pressure and also saves power and clean liquid refrigerant instead of refrigerant contaminated with oil, substantially increasing the chilling capacity of evaporator 53. Also, this system is applicable to two stage operations.

Figure 4:
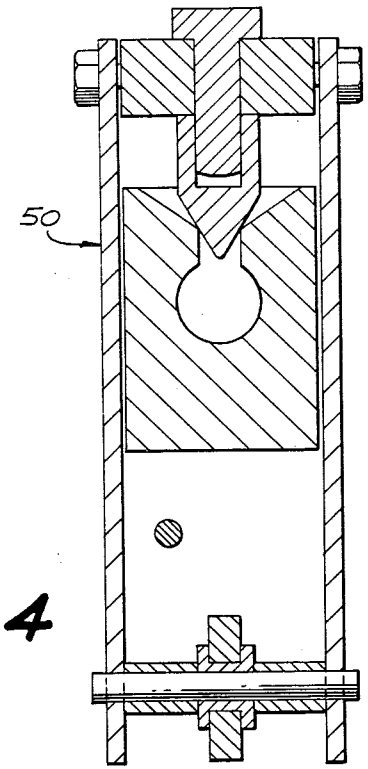
FIG. 4 is a sectional view through float expansion valve.
Figure 2:
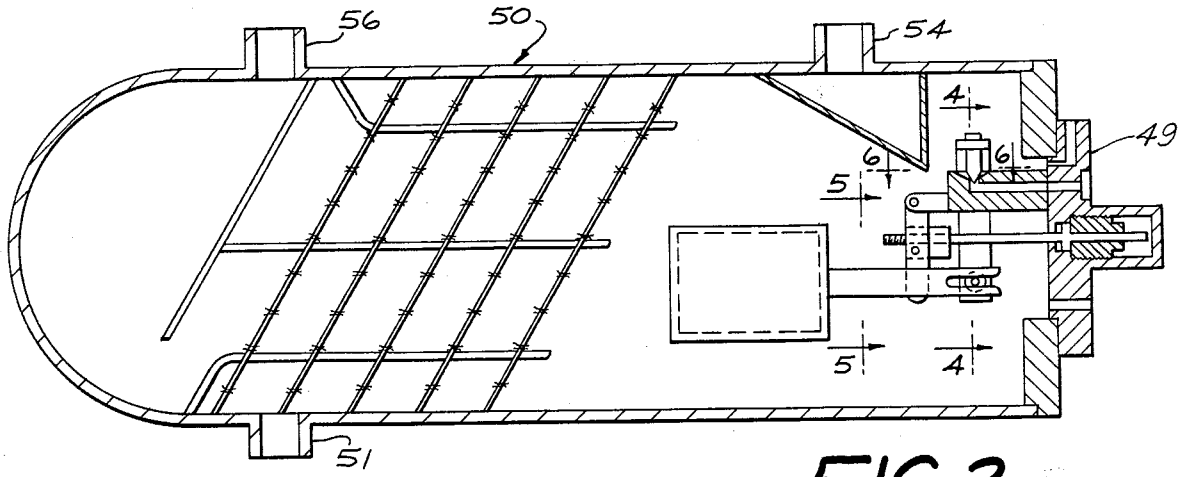
FIG. 2 is a sectional view of combination float valve tank and knock-out drum.
Figure 3:
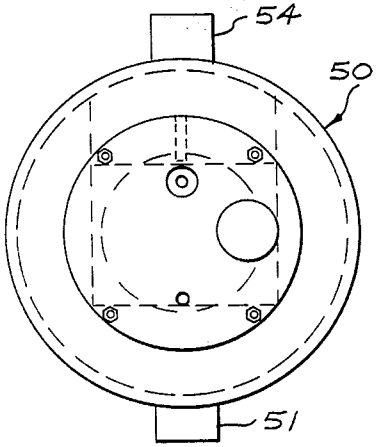
FIG. 3 is an end view of float tank with connections located.

Reference now is made to FIG. 2, showing combination float valve tank and knock-out drum as part 50 in FIG. 1 with control valves 48-49-52 and 55. The solenoid valve 48 is controlled by a float switch connected to openings in float valve flange, FIG. 3, as extra protection for the compressor, in case of malfunction of float expansion valve 49 as shown in FIG. 4, which opens with low liquid level and closes with high liquid level. The liquid level is adjustable by turning screw E clockwise changing the fulcrum or pivot point F and increasing the liquid level which causes wet gas to discharge from the evaporator to increase chilling capacity.

The high pressure liquid refrigerant from line 47 (FIG. 1) in opening A and part of the liquid flashes to gas as the pressure is changed from 154# to 20# and reduces the temperature from 86° F. to 5° F., which creates high velocity gas and liquid discharging from expansion valve (FIG. 4) which is well above the float and liquid level to minimize disturbance.

The cold liquid flows from outlet B at bottom of tank to the evaporator, where the liquid is vaporized by cooling air and the wet gas is returned to top inlet D which strikes solid slanted baffle to minimize agitation.

The cold wet gas from the expansion valve and the evaporator flows through a series of slanted apertured baffles where the cold mist will coalesce and collect on surfaces with the droplets gravitating down in the liquid layer; the dry cold gas passes around solid baffle in center of the vessel and flows out connection C, which is connected to the slop tank and compressor.

This combination float valve tank and knock-out drum improves the operation by increasing the chilling capacity of the evaporator when discharging wet gas instead of superheated gas, also the baffles reduce liquid carried over into the compressor and extra safety is provided by using both float valve and float switch to prevent high liquid level causing damage.

Referring to FIG. 4, showing expansion valve actuated by a float through the vertical bars for positioning the valve and controlling the liquid level.

Figure 5:
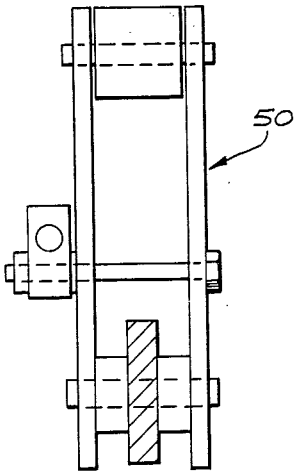
FIG. 5 is a sectional view of adjustable pivot point.

Referring to FIG. 5, showing section through adjustable fulcrum or pivot point for changing the liquid level during operation.

Figure 6:
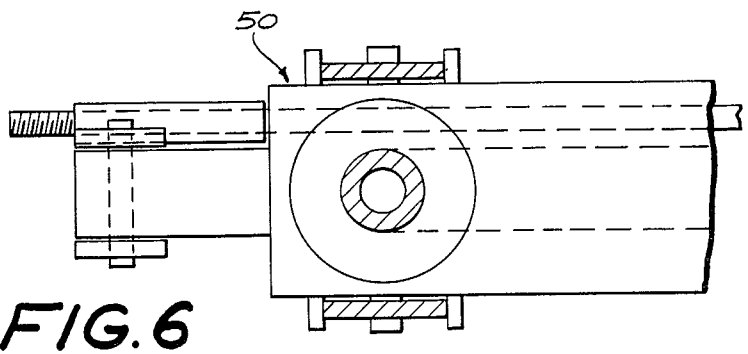
FIG. 6 is a top view of float valve assembly.

Referring to FIG. 6, showing top view of expansion valves with vertical bar and guide pins.

Figure 7A:
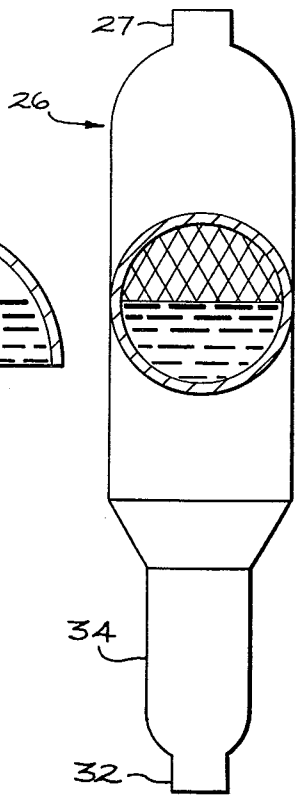
FIG. 7 and FIG. 7A are sectional views of non-entrainment trap.
Figure 7:
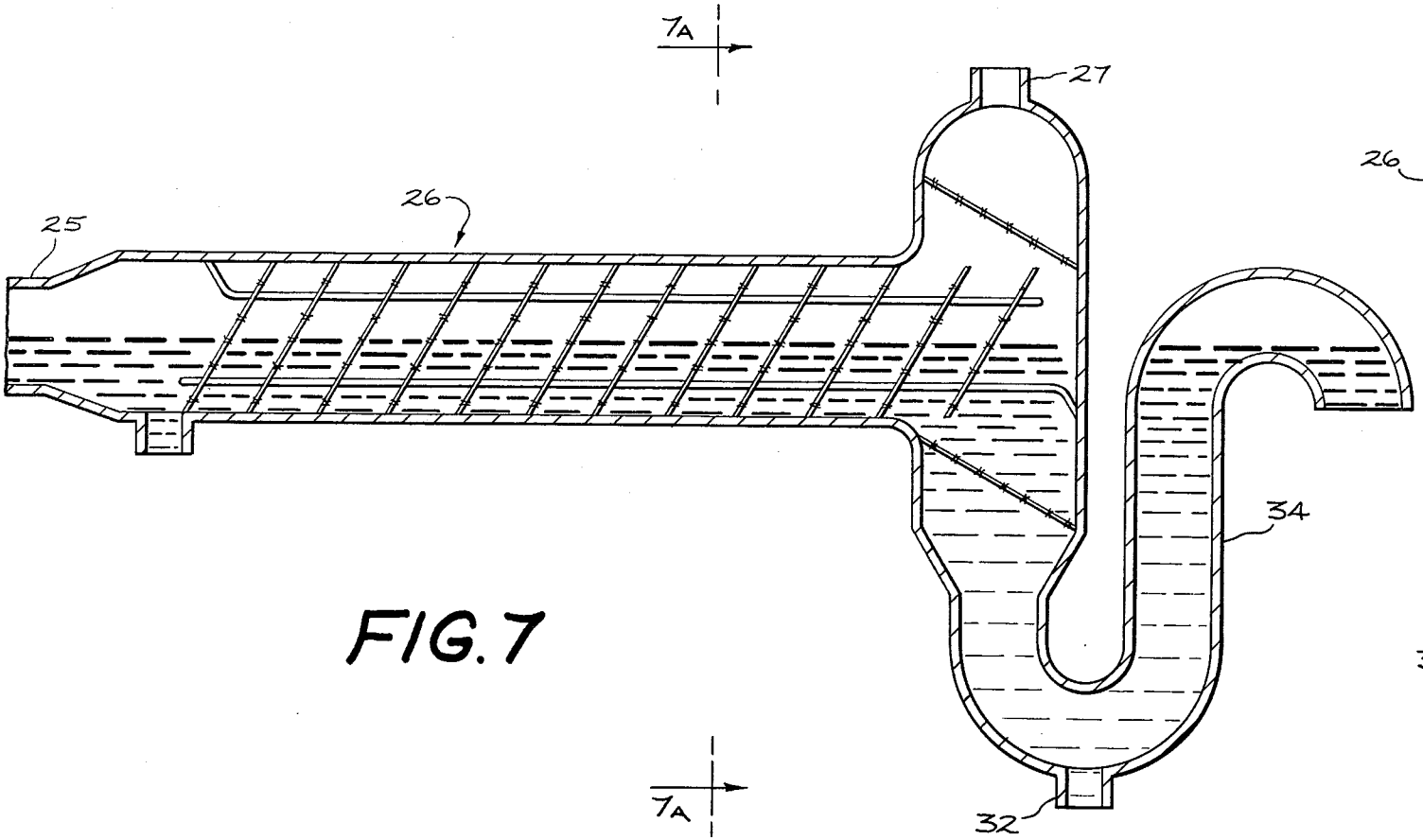

Reference is now made to FIG. 7, showing section through non-entrainment trap: for collecting the non-condensible gases that accumulate in bottom of the condenser and collect in trap assembly 26 in FIG. 1. The liquid and gas from bottom header of said condenser 24 (FIG. 1) flows through line 25 (FIG. 1) partially filled with liquid to minimize agitation and provide space for gases to be drawn from the condenser coil above the liquid level in said line 25 connected into larger body of trap 26 with a series of slanted apertured baffles to stabilize the liquid and rupture any foam bubbles as the gas and liquid flow concurrent through the baffle structure.

The liquid overflows from bottom of the liquid pool through line 34 to maintain the desired liquid level in the trap and minimize gas entrainment in the liquid flowing to the receiver through line 35, 36 and 37 (FIG. 1). The gases that do not condense at operating temperature and pressure in condenser 24 (FIG. 1) are drawn from top of trap 26 (FIG. 1) through line 27 (FIG. 1) into the low temperature and high pressure condenser 28 (FIG. 1). The refrigerant gas is condensed to a liquid and overflows through line 30 into line 35 (FIG. 1) at lower elevation. Line 32 from bottom of the trap provides the liquid for cooling said non-condensible gases.

Figure 8:
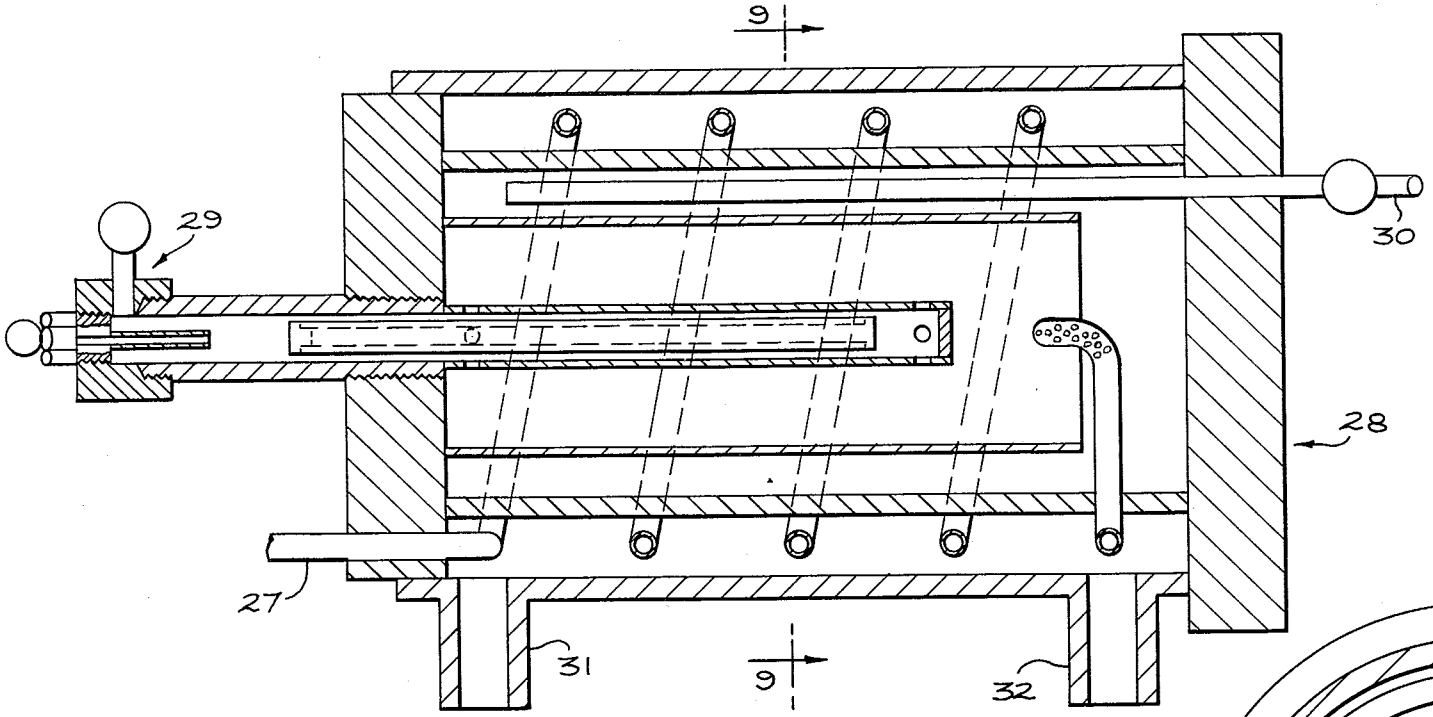
FIG. 8 is a sectional view of low temperature high pressure condenser.

Reference to FIG. 8 showing section through low temperature and high pressure condenser for condensing the refrigerant gas in non-condensible gas from trap 26 (FIG. 1) and/or other sources to salvage the refrigerant gas before venting the non-condensible gases to the atmosphere. The assembly 28 consists of jacketed pot for sub-cooling the non-condensible gases flowing down through coil 27' from non-condensible collector where the refrigerant gas is condensed at suction temperature and condenser pressure on the mixed gases.

The gas passing through the coil is cooled and condensed by expanding liquid refrigerant from outlet 32 (FIG. 1) of trap 26 (FIG. 1) into inlet at bottom of jacket at suction pressure and about 5° F. with the gas created by evaporating liquid returned to the compressor suction through line 31, (FIG. 1), 62 (FIG. 1) and the slop tank 57 (FIG. 1). The cold liquid and gas flows from bottom end of coil through the small holes where the gas bubbles up through the cold liquid to further cool and condense refrigerant gas and the non-condensible gas collects in the accumulator tube with bottom end open for equalizing pressure and flow of liquid from said tube into annulus around tube with liquid overflow line 30 for controlling liquid level in the annulus area, and connected into liquid line 35 (FIG. 1) at lower elevation and equalized pressure causing the cold liquid from condenser and separator 28 (FIG. 1) to flow back into the main liquid line 35 (FIG. 1). Also, condenser 28 may be elevated to cause the cold liquid to flow into trap 26 to further sub-cool the liquid and reduce flashing.

The non-condensible gases accumulate in the top of tube with bottom end open and above the liquid in said tube, where the non-condensibles are automatically vented through assembly 29, which is attached to the top head of assembly 28 and extending down into gas accumulating space as guide tube for bullit type float designed for various densities of liquid refrigerants. The gases flow through holes in the guide tube up around the float and through capillary tube with needle valve A for regulating the flow rate when the liquid level is low and the float is not contacting the capillary tube. Also, gases can be vented rapidly through vent valve B.

The liquid rises in the gas space as the gas is vented to the atmosphere, which causes the float to raise and close the end of capillary tube and stops gas flow. The liquid is forced from gas accumulator into the annulus with overflow line 30 as gases accumulate above the liquid, and the float falls away from the capillary tube as the liquid is forced from gas accumulator into annulus area and overflow line returning to main liquid line. The non-condensible gases are again vented from the gas accumulator and the liquid rises around the float to lift the float and close the automatic vent at the desired liquid level to complete the vent cycle.

The automatic vent may be constructed from a combination of metal and transparent parts so the operation of the float can be observed and vent rate adjusted for most efficient operation. Also, the refrigerant required to condense the refrigerant gas at low temperature and high pressure is salvaged by cooling the high pressure liquid before it enters the expansion valve and reduces the amount of flash gas created at the expansion valve.

Figure 9:
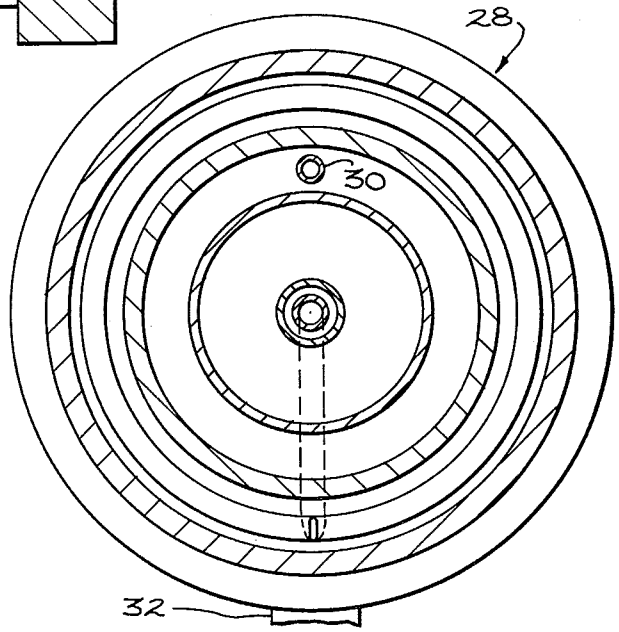
FIG. 9 is a sectional view of condenser FIG. 8.

Referring to FIG. 9, showing cross section of the low temperature high pressure condenser with tube and coil arrangement.

Figure 10:
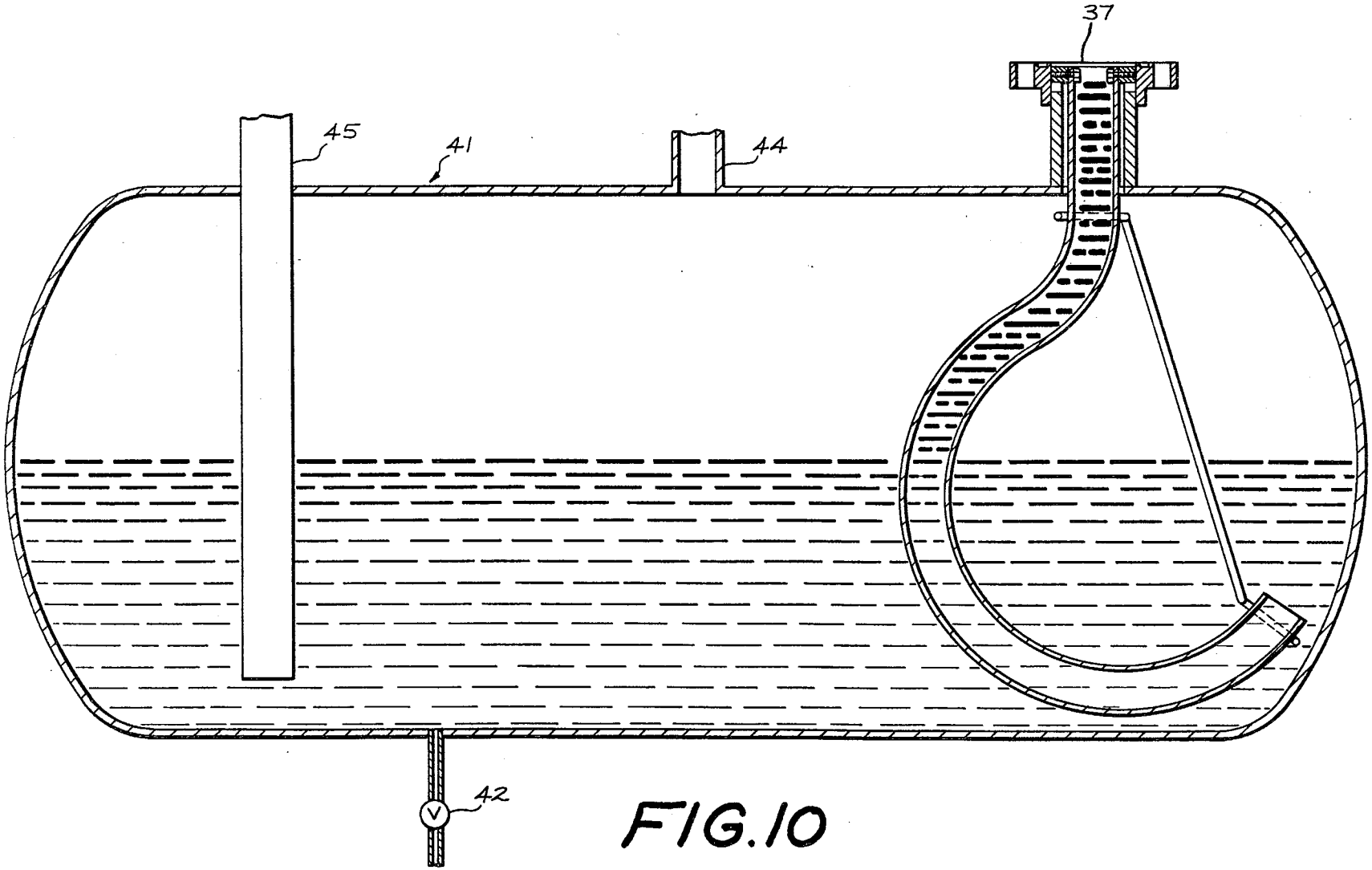
FIG. 10 is a horizontal sectional view of standard receiver with non-agitating trap.

Referring now to FIG. 10, showing section of receiver 41 in FIG. 1 with the non-agitating trap inserted in the liquid inlet connection to minimize agitation caused by falling liquid from the elevated condenser. Also, this flexible trap deflects the liquid upward and above any oil in the receiver to prevent disturbing the oil, and permit draining oil from valve 42 during operation, which substantially improves the chilling efficiency of evaporator 53 when evaporating clean liquid instead of oil contaminated liquid ammonia. The flexible trap is applicable to ammonia receivers now in operation and is simple to install by opening the liquid line flange near the vessel and inserting the flexible hose trap with proper length wire to turn the outlet end upward above the oil level in the receiver. Also the positioning collar on inlet end of the flexible trap is pushed down on the soft gasket and locked in position with locking screws to reduce the velocity and minimize agitation.

Figures 11, 11A:
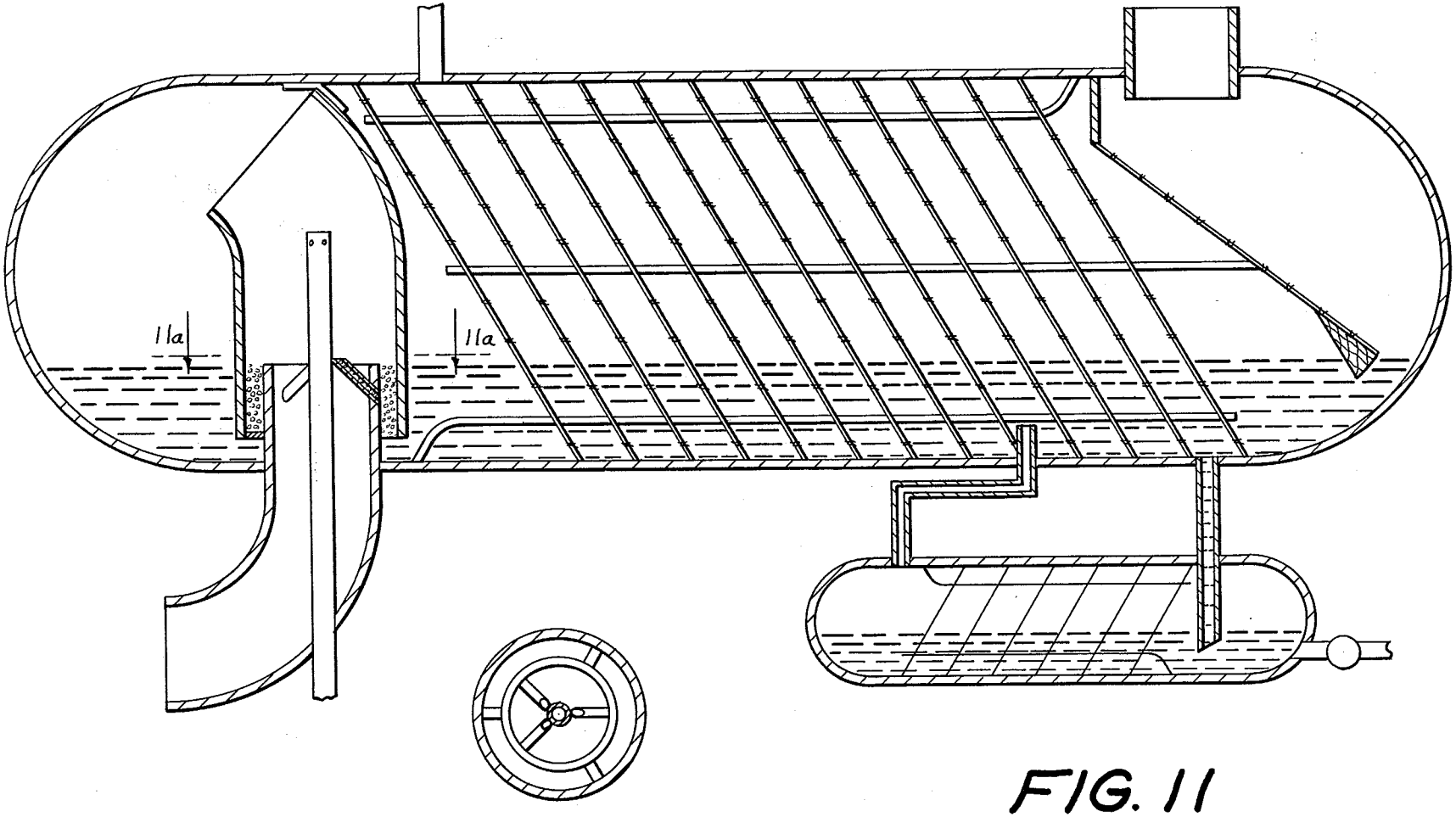
FIG. 11 and FIG. 11A are horizontal sectional views of desuperheater and separator unit with improved contact inlet connection.

Referring to FIG. 11, showing section through my Desuperheater & Separator unit covered by claims in U.S. Pat. No. 3,837,175 and shown in FIG. 3 of this patent, the improvements comprise inlet connection assembly 110 for circulating more liquid, improving the desuperheating and oil collection in the slanted apertured baffle section.

The improved inlet assembly 110 is connected to the hot (contaminated) gas line 81 from the compressor, the hot gas heats the 90° elbow and pipe extending up into the bottom of the vessel partially filled with liquid ammonia at condenser pressure. The liquid flashes to gas and reduces density of liquid and gas mixture flowing up the annulus around the hot pipe and inside of the larger desuperheating and deflecting pipe 82. Also the hot pipe is arranged with multiple inclined tubes to distribute the low density mixture of gas and liquid near the center of hot gas stream from the compressor. The low density mixture is forced into the hot gas stream at reduced velocity in the large desuperheating pipe by the heavier liquid surrounding this pipe; the liquid flashes and creates more gas as the hot gas with oil from the compressor is cooled (desuperheated) before the gas enters the stationary baffle structure for rupturing foam bubbles and the cooled mist will coalesce and collect on surfaces of the slanted apertured baffles with zig-zag flow pattern. The oil droplets gravitate down through the liquid ammonia layer due to the density difference in oil and liquid ammonia, and collect in oil trap 90 to be removed. The oil may be filtered and returned to the compressor.

The forced circulation by reducing the density causes more liquid to circulate through the desuperheating pipe and improves contact of liquid and hot contaminated gas from the compressor.

The increased volume of clean cooled gas flows from top of the D & S unit through line 24 up to the elevated condenser where the gas is condensed to liquid with lower head pressure to the higher heat transfer coefficient.

The coefficient is increased first by removing the oil before the gas enters the condenser—second, the coefficient is much higher when condensing gas than it is when cooling gas; also more surface is available for condensing gas when the gas is desuperheated—and third the cooled gas reduces scale formation on the condenser tubes. The increased heat transfer coefficient saves power to operate the compressor by reducing the head pressure, and clean liquid instead of liquid refrigerant contaminated with oil substantially improves the efficiency of the evaporator.

Figure 12:
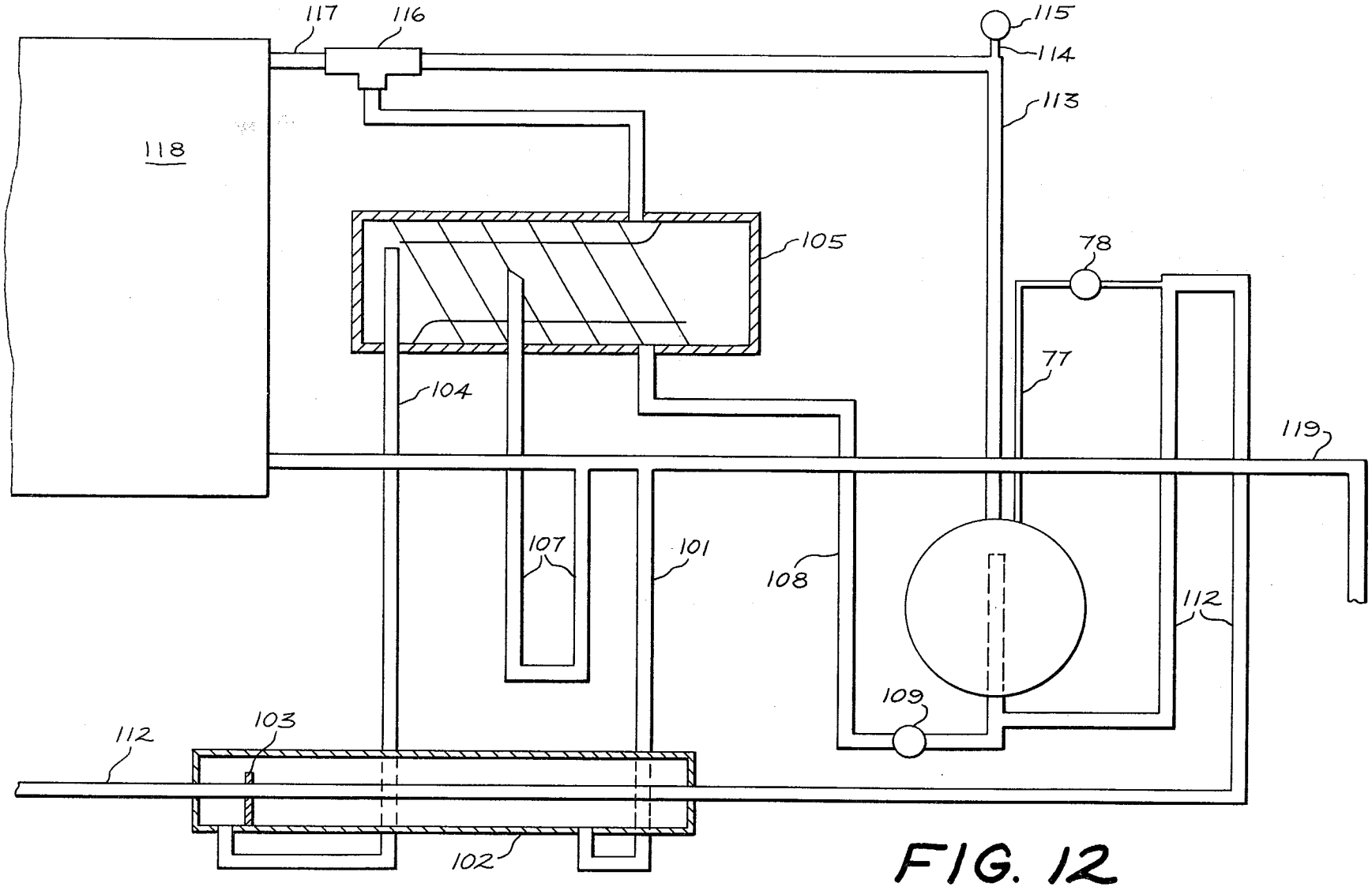
FIG. 12 is a diagrammatic piping arrangement to lift or circulate evaporative liquids by changing density.

Referring now to FIG. 12, showing a schematic flow diagram of refrigeration system with condenser and desuperheater and separator unit on about the same elevation with means for elevating part of the liquid to increase the static head of liquid to overcome the pressure drop, flow resistance in gas flowing through the D & S unit, the siphonic tee and into top of the condenser to be condensed, the invention comprises reducing the density of liquid refrigerants creating gas at the condenser pressure while cooling hot gas at the same pressure, a jacketed section of the hot gas line from the compressor is located well below liquid outlet line 119 with line 101 from said line 119 into bottom of jacket 102 around the hot gas line 112 with partial baffle 103 above the hot line 112 to force liquid and gas to pass over said baffle and cause hot line to be covered with liquid refrigerant at all times. The gas created as the hot gas is cooled by flashing liquid at the condenser pressure passes over baffle 103 and out the bottom of jacket through line 104 as mixture of gas and liquid at reduced density and is forced to higher elevation by static head of heavier liquid in line 101 at equalized pressure. The amount of liquid elevated and the distance the liquid is raised is a direct function of the amount of gas created in jacket 102 by cooling hot gas in line 112. As an example, if hot jacketed line is 10 ft. below the liquid line 119 and the hot line 112 creates 1 cu.ft. of gas per hour at condenser pressure would lift 1 cu.ft. of liquid per hour at same pressure slightly less than 20 ft. due to the density difference in line 101 and 104.

The mixture of gas and liquid flows up into elevated separator tank 105 where the liquid settles to bottom of said tank and the gas is returned from the top of the tank to the condenser 118 through line 111, siphonic tee 116 and line 117.

The high velocity gas flowing through the siphonic tee creates siphonic action to draw gas from line 111 at equalized pressure. The liquid from tank 105 elevated 10 ft. or more above the D & S unit flows through control valve 109 through line 108 into inlet connection 110 in the D & S unit shown in FIG. 11 for further desuperheating the hot gas entering the D & S unit from line 112 after passing through cooling jacket 102 from the compressor. The clean cooled gas is forced from the D & S unit by the compressor through line 113 with branch line 114 and valve 115 for defrosting the evaporator by condensing clean gas, also through siphonic tee 116 at high velocity to draw in gas from line 111 and force the gas through line 117 into the condenser to be condensed to liquid and returned to liquid outlet line 119 to complete the cycle. The surplus liquid in tank 105 is returned to line 119 through overflow line 107. The liquid lift by reducing density is applicable for plants where liquid refrigerant pumps are restricted, also saves power and maintenance cost.

What is claimed is:

1. In an improved refrigerating system of the type which includes (A) an evaporator for circulating a fluid refrigerant therethrough to absorb heat from a refrigerating medium, whereby said medium is cooled and said refrigerant is converted from a liquid to a gas, (B) an oil lubricated compressor connected in receiving relation to said evaporator for compressing and superheating said gas, (C) a condenser connected in receiving relation to said compressor for condensing said compressed gas to form a liquid, and (D) a receiver connected in liquid receiving relation to said condenser for storing said liquid and connected in liquid supplying relation to said evaporator, the improvement comprising (E) heat exchanger means having a liquid refrigerant confining shell and a heat exchanger tube disposed in said shell, an inlet end of said tube being connected in receiving relation to said compressor for receiving said compressed, superheated gas therein, said shell having an inlet port connected in receiving relation to an outlet port of said condenser for circulating a portion of the liquid refrigerant condensed in said condenser about said tube to partially desuperheat said compressed gas, and (F) an impurity removing oil-mist separator/collector unit connected in receiving relation to an outlet end of said tube for removing impurities, including oil, from said partially desuperheated gas, said unit being connected in supplying relation to said condenser for supplying cleaned, partially desuperheated gas to said condenser.

2. The system of claim 1 further comprising wet gas separating means connected to an outlet overflow port of said shell for separating gas refrigerant formed in said shell from the liquid refrigerant flowing from said shell after circulating about said tube to partially desuperheat said compressed gas, said wet gas separating means being connected in gas supplying relation to said condenser and in liquid supplying relation to said receiver.

3. The system of claim 2 wherein said wet gas separating means comprises a tank defining a chamber, a tank inlet port communicating with one end portion of said chamber and being connected in receiving relation to said shell outlet port, and a tank outlet port communicating with a bottom of the other end portion of said chamber and being connected in liquid supplying relation to said receiver, a plurality of spaced, slanted, apertured baffles disposed in said chamber between said tank inlet and outlet ports for rupturing gas bubbles contained in the liquid flowing into said chamber from said shell and for deflecting said liquid downward into a lower portion of said chamber, said tank further defining a gas vent port communicating with an upper portion of said chamber, and siphoning means connected between said gas vent port and said condenser inlet port for drawing gas refrigerant accumulated in said tank upper portion into said condenser.

4. The system of claim 3 wherein said siphoning means comprises a siphonic tee having an inlet port connected to said separator/collector unit, an outlet port connected to said condenser inlet port, and a siphonic port connected to said tank gas vent port for drawing gas from the upper portion of said tank chamber into a gas stream flowing through said tee between said tee inlet and outlet ports and into said condenser.

5. The system of claim 1 further comprising non-entrainment trap means connected between said condenser outlet port and said heat exchanger shell inlet port and receiver for separating and removing gases entrained in said condensed liquid.

6. The system of claim 5 wherein said non-entrainment trap means comprises (A) an entrance body defining a hollow chamber and having an inlet port communicating with said chamber and connected to said condenser outlet port, (B) a plurality of spaced, slanted, apertured baffles disposed in said entrance body chamber for rupturing bubbles of non-condensable gases discharged with said condensed liquid from said condenser outlet port and for stabilizing said liquid in said entrance body chamber to form a liquid pool in a lower portion thereof, and (C) a U-shaped exit section communicating with said entrance body and having a liquid overflow outlet port positioned a preselected distance above the bottom of said entrance body chamber to establish a preselected liquid level in said entrance body chamber, said entrance body defining a gas vent port communicating with an upper portion of said entrance body chamber above said liquid pool, said overflow outlet port being connected to supply a portion of the liquid in said pool to said heat exchanger shell, said U-shaped exit section further defining a liquid outlet port on a lower portion thereof for drawing liquid from the bottom of said pool, said exit section outlet port being connected in liquid supplying relation to said receiver.

7. The system of claim 5 further comprising condensing means connected in gas receiving relation to said trap means for condensing and liquifying at least a portion of the condensable gas contained in said gases as separated and removed from said condensed liquid by said trap means, the resulting uncondensed gases being vented from said condensing means to atmoshere, said condensing means being connected in liquid supplying relation to said shell inlet port and receiver for combining the liquid condensed in said condensing means with the liquid supplied to said shell inlet port and receiver by said trap means.

8. The system of claim 1 further comprising valve means connected between said trap means and condensing means for supplying at least a portion of said condensed liquid from said trap means to said condensing means at reduced pressure such that said liquid supplied to said condensing means is cooled sufficiently to condense said portion of said condensable gas in said condensing means, said condensing means being connected in gas supplying relation to said compressor to supply gas to said compressor vaporized in said condensing means from the reduced pressure liquid occasioned by the condensing of said condensable gas.

9. The system of claim 7 wherein said condensing means comprises a housing defining a liquid and gas tight hollow enclosure, a jacket formed in said enclosure defining a closed annular chamber around a closed central chamber, a heat exchanger tube disposed in said annular chamber and having an upper inlet end connected through said housing and in gas receiving relation to said trap means, said tube having a lower outlet end projecting through a lower portion of said jacket into a lower central portion of said central chamber, a skirt disposed in said central chamber and closed at an upper end thereof against an upper surface of said central chamber, said skirt opening on a lower end thereof in a lower portion of said central chamber around said tube outlet end and spaced above a floor of said central chamber, float valve means projecting through said housing and downward into said central chamber inside of said skirt for permitting uncondensed gases discharged from said tube outlet end to escape from said enclosure to atmosphere when a liquid level in said skirt is less than a first preselected height above said floor and for preventing the escape of said uncondensed gases from said enclosure when a liquid level in said skirt is at least equal to said first preselected height above said floor to force liquid to rise in said annular chamber, liquid overflow means disposed in said central chamber between said skirt and jacket for draining a liquid from said central chamber and enclosure when said liquid in said central chamber is at least equal to a second preselected height above said floor, pressure reducing means connected between said trap means and said annular chamber for supplying relatively cold liquid to a lower portion of said annular chamber to circulate about at least a lower portion of said tube to condense at least a portion of the condensable gas flowing downward through said tube, and means communicating with an upper portion of said annular chamber and connected in gas supplying relation to said compressor for supplying gas to said compressor accumulated in said upper portion of said annular chamber vaporized from said relatively cold liquid in said lower portion of said annular chamber occasioned by the condensing of condensable gas flowing downward through said tube.

10. The system of claim 1 wherein said receiver comprises a tank defining a closed chamber having a liquid inlet port, a flexible hose disposed in said tank chamber and having an inlet end connected to said tank inlet port, and securing means disposed in said tank chamber and connected to said hose for securing an outlet end of said hose in an upwardly opening position spaced above a bottom of said tank chamber, whereby said hose forms a non-agitating trap inserted in said liquid inlet port to minimize agitation of a liquid stored in said tank otherwise caused by a liquid falling into said chamber from an elevated condenser, and for preventing agitation of oil settled in a bottom portion of said tank.

11. The system of claim 10 wherein said securing means comprises a cable strung between inlet and outlet end portions of said hose.

12. The system of claim 1 further comprising liquid and gas separating means connected in liquid receiving and supplying relation between said receiver and an inlet end of said evaporator, said liquid and gas separating means being further connected in wet gas receiving relation to an outlet end of said evaporator and in dry gas supplying relation to said compressor, for supplying a quantity of cold liquid refrigerant to said evaporator sufficient to maintain at least a partial liquid refrigerant presence throughout said evaporator to enhance the chilling efficiency thereof while supplying only dry gas to said compressor to protect said compressor from liquid damage.

13. The system of claim 12 wherein said liquid and gas separating means comprises a combination float valve tank and knockout drum.

14. The system of claim 12 wherein said liquid and gas separating means comprises a tank defining an enclosed chamber and having liquid inlet and outlet ports, a dry gas outlet port and a wet gas inlet port, means for limiting the quantity of a liquid refrigerant supplied to a lower portion of said chamber to a preselected amount, pressure reducing liquid inlet means responsively connected to said limiting means for supplying a liquid refrigerant from said receiver into said chamber at reduced pressure to thus cool said liquid refrigerant, and baffle means disposed in said chamber between said liquid and wet gas inlet means and port, and said liquid and dry gas outlet ports for separating liquid from wet gas and for collecting the liquid thus separated in said lower portion while accumulating resulting dry gas in an upper portion of said chamber.

15. The system of claim 14 wherein said baffle means comprises a plurality of slanted, apertured baffles.

16. The system of claim 14 wherein said limiting means comprises a float valve for activating said pressure reducing means when the liquid in said lower portion is less than a preselected amount and for de-activating said pressure reducing means to stop the flow of liquid from said receiver to said chamber when the liquid in said lower portion is at least equal to said preselected amount.

17. In an improved ammonia refrigerating system of the type which includes (A) an evaporator for circulating liquid ammonia refrigerant therethrough to absorb heat from a refrigerating medium to cool said medium, whereby said refrigerant is at least partially converted from a liquid to a gas, (B) an oil lubricated compressor connected in gas receiving relation to said evaporator for compressing and superheating said gas, (C) a condenser connected in gas receiving relation to said compressor for condensing said compressed gas to form ammonia liquid, (D) a receiver connected in liquid receiving relation to said condenser for storing said liquid, and connected in liquid supplying relation to said evaporator, and (E) a combination desuperheater and oil mist separator/collector unit connected in gas and liquid receiving relation to said compressor and condenser, respectively, and in gas and liquid supplying relation to said condenser and receiver, respectively, for partially desuperheating hot gas received from said compressor, for separating liquid from gas refrigerant, for separating and collecting oil from said liquid therein, and for supplying cleaned, cooled gas refrigerant to said condenser, the improvement of which comprises inlet means disposed in said unit including (F) a first inlet pipe connected in liquid receiving relation to said condenser and having an outlet end opening in said unit above a liquid level therein, (G) a second inlet pipe connected in hot gas receiving relation to said compressor and projecting upwardly in said unit around said first pipe and having an outlet end opening near said liquid level, (H) a deflecting pipe disposed in said unit and having a lower open end disposed over and around said second pipe and spaced above a bottom inside surface of said unit, whereby a portion of said liquid in said unit will circulate upwardly between said second and deflecting pipes and evaporate to form a relatively low density mixture of liquid and gas, which mixture will flow upwardly to mix with a hot, oil contaminated gas flowing from said compressor through said outlet end opening of said second inlet pipe, an upper end of said deflecting pipe opening above said liquid level toward an inside wall of said unit.

18. The system of claim 17 further comprising a plurality of inclined tubes attached around the walls of said second pipe and projecting upwardly toward said first pipe for improved contact of said low density mixture and said hot, oil contaminated gas.

19. The system of claim 17 further comprising means for overcoming pressure drop of the gas supplied from said unit to said condenser when said unit and condenser are located at or near the same elevation.

20. The system of claim 17 wherein said condenser and unit are disposed at or near the same level, said system further comprising a first liquid line connected between an outlet port of said condenser and said receiver, a hot gas line connected between said compressor and said second pipe, at least a portion of said hot gas line being located below the level of said first liquid line, a jacket disposed around said portion of said hot gas line, said jacket being connected in liquid receiving relation to said first liquid line so that liquid in said first liquid line will gravitate downwardly into said jacket for circulation around said portion of said hot gas line to partially evaporate and form a mixture of liquid and gas of relatively lower density than the liquid gravitating downwardly into said jacket, a wet gas separator disposed above said jacket, first liquid line and unit, and being connected in wet gas receiving relation to said jacket, whereby the heavier density liquid gravitating downwardly from said first liquid line into said jacket forces the relatively lighter density mixture of liquid and gas formed in said jacket upwardly into said separator, and a second liquid line connected between a bottom portion of said wet gas separator and extending downwardly to connect to said first pipe for permitting a liquid separated from said mixture in said separator to gravitate into said unit.

21. The system of claim 20 further comprising gas siphoning means connected between said unit and an inlet port of said condenser and communicating with said separator for drawing a gas separated from said mixture in said separator into said condenser.

* * * * *